US005954402A

United States Patent [19]

McInturff

[11] Patent Number: 5,954,402

[45] Date of Patent: Sep. 21, 1999

[54] SIZE-ADJUSTABLE LOAD SUPPORTING DEVICE FOR WHEELCHAIRS

[75] Inventor: David A. McInturff, Akron, Ohio

[73] Assignee: Crown Therapeutics, Inc., Belleville, Ill.

[21] Appl. No.: 08/847,702

[22] Filed: Apr. 28, 1997

[51] Int. Cl.[6] ..... A47C 5/10

[52] U.S. Cl. ..... 297/440.22; 297/440.24; 297/DIG. 6; 297/452.2; 297/452.4

[58] Field of Search ..... 297/452.2, 452.4, 297/440.22, 440.24, DIG. 6, 440.2, 252; 248/205.2, 298.1

[56] References Cited

U.S. PATENT DOCUMENTS

| | | | |
|---|---|---|---|
| 567,491 | 9/1896 | Murphy . | |
| 1,945,113 | 1/1934 | Kloboucnik . | |
| 2,534,009 | 12/1950 | Freasier et al. . | |
| 2,743,049 | 4/1956 | Flesher . | |
| 2,788,188 | 4/1957 | Smith et al. | 248/298.1 X |
| 3,158,398 | 11/1964 | Stryker . | |
| 3,209,374 | 10/1965 | Walz . | |
| 3,220,767 | 11/1965 | Hendrickson | 297/440.22 X |
| 3,821,825 | 7/1974 | Bailey | 297/252 X |
| 4,365,840 | 12/1982 | Kehl | 297/440.22 X |
| 4,375,295 | 3/1983 | Volin | 297/452.4 X |
| 4,398,766 | 8/1983 | Everett | 297/252 |
| 4,629,246 | 12/1986 | Fulton . | |
| 4,729,336 | 3/1988 | Rohne | 297/252 X |
| 4,881,997 | 11/1989 | Hatch | 297/DIG. 6 X |
| 4,911,389 | 3/1990 | Self | 248/205.2 X |
| 5,074,620 | 12/1991 | Jay et al. | 297/252 X |
| 5,098,157 | 3/1992 | Surot . | |
| 5,115,529 | 5/1992 | White | 297/440.22 X |
| 5,352,023 | 10/1994 | Jay et al. | 297/DIG. 6 X |
| 5,407,248 | 4/1995 | Jay et al. | 297/DIG. 6 X |
| 5,547,259 | 8/1996 | Frederick | 297/452.4 X |
| 5,551,750 | 9/1996 | Yoshimura | 297/DIG. 6 X |
| 5,551,756 | 9/1996 | Gurasich | 297/440.22 X |
| 5,564,786 | 10/1996 | Peek et al. | 297/452.4 |

FOREIGN PATENT DOCUMENTS

| | | | |
|---|---|---|---|
| 352001944 | 1/1977 | Japan | 248/298.1 |

*Primary Examiner*—Peter M. Cuomo
*Assistant Examiner*—David E Allred
*Attorney, Agent, or Firm*—Howell & Haferkamp, L.C.

[57] ABSTRACT

A size-adjustable load supporting device comprising a load supporting top panel and a size-adjustable support frame. The support frame is adjustable laterally and longitudinally to fit a variety of wheelchairs and to accommodate different sized patients. The load supporting top panel is removably attached to the size-adjustable frame with VELCRO®. The support frame is comprised of four T-shaped components which are nestingly interfit with one another and slidable relative to one another to form a generally square support frame. With the top panel removed, the length and width of the support frame can be quickly adjusted by sliding the T-shaped components relative to one another to vary the amount of nesting. Once the support frame is adjusted to the desired size, the top panel is reattached, thereby securing the support frame. Four J-shaped brackets are provided, two on each side, to allow the device to be easily mounted on a standard wheelchair. The brackets are vertically adjustable and rotatable relative to the support frame to permit the size-adjustable load supporting device to be mounted at a range of heights and at a variety of angles relative to the wheelchair frame.

18 Claims, 5 Drawing Sheets

SIZE-ADJUSTABLE LOAD SUPPORTING DEVICE FOR WHEELCHAIRS

BACKGROUND OF THE INVENTION (1) Field of the Invention

The present invention pertains to a load supporting device for use with conventional wheelchair frames. More particularly, the present invention pertains to a wheelchair seat or back rest which is adjustable laterally and longitudinally to fit most conventional wheelchair frames and to accommodate different sized wheelchair patients.

(2) Description of the Related Art

In a conventional wheelchair, a soft "sling" type seat is suspended between spaced apart rails of the wheelchair frame for supporting the weight of the wheelchair user. Similarly, many conventional wheelchairs use "sling" type upholstery for the wheelchair back rest. However, these soft "sling" type wheelchair seats or back rests can aggravate many of the health problems suffered by wheelchair users.

Persons who use wheelchairs for extended periods of time may require the use of inflatable wheelchair seat cushions to prevent the formation of decubitus ulcers. Inflatable wheelchair cushions, such as the one disclosed in co-assigned U.S. Pat. No. 5,561,875, serve to distribute the weight of the supported body evenly over the area of the body that is in contact with the cushion. The inflatable cushions are generally placed on top of the wheel chair seat. However, the effectiveness of such inflatable cushions is significantly diminished by the curved configuration of a conventional "sling" type wheelchair seat. Moreover, by stacking an inflatable cushion on top of the "sling" seat, the effective seat height is raised an amount equal to the thickness of the inflatable cushion. This may result in the patient not being able to properly reach the foot plates of the wheelchair. It also raises the center of gravity of the patient.

Attempts have been made to replace the "sling" type wheelchair seat with a flat, rigid seat base which can be suspended low enough between the spaced apart rails of the wheelchair frame to accommodate the thickness of an inflatable cushion. For example, U.S. Pat. No. 4,629,246 of Fulton discloses a rigid wheelchair seat base which is hook mounted onto a wheelchair frame. The seat base can be easily removed to facilitate collapsing of the wheelchair for transportation and storage. However, the seat base disclosed in the Fulton patent is not, under normal circumstances, size-adjustable. Consequently, the seat base must be custom constructed for each individual wheelchair and wheelchair user. This can become expensive, even for a single wheelchair user who may require different seat bases as his or her physical needs change over time.

More recently, attempts have been made to provide size-adjustable wheelchair seat bases which can be adjusted to fit a variety of wheelchair frames and to accommodate the current and changing needs of the wheelchair user. For example, U.S. Pat. No. 5,074,620 of Jay et al. discloses a wheelchair seat base which may be adapted to fit a variety of wheelchair frames and which is adjustable to fit different sized users. However, the means for adjusting the length and width of the seat are quite cumbersome and require the use of tools to accomplish any size adjustment. Moreover, the size-adjustment means are rather limited with the seat base being capable of only a few different sizes.

SUMMARY OF THE INVENTION

It is an object of this invention to provide a size-adjustable load supporting device for wheelchairs which may be quickly and easily adjusted, without tools, to fit most conventional wheelchair frames and to accommodate most wheelchair users. It is also an object of this invention to provide a device that, while being easily size-adjustable, provides sound mechanical support for the wheelchair user. Still another object is to provide a load supporting device capable of being mounted to a conventional wheelchair frame at a variety of angles to achieve various therapeutically significant functions. A further object of this invention is to provide a size-adjustable load supporting device which may be retro-fitted onto the majority of existing conventional wheelchairs, or which can be used as original equipment on new wheelchairs.

Accordingly, the above-described problems encountered by the prior art have been solved by the present invention which provides a size-adjustable load supporting device comprising a size-adjustable support frame and a load supporting panel removably fastened to the support frame.

Preferably, the support frame has a generally square configuration which is defined by four substantially T-shaped frame components which are mounted together. The T-shaped frame components are dimensioned to slidably nest with one another at a range of spaced apart distances. Some of the components are penetrating components and others are receiving components which are configured for telescoping reception of the penetrating components. The spaced apart distances of the frame components relative to one another therefore depends upon the degree of nesting or telescoping of the components.

By varying the amount of nesting or telescoping of the T-shaped frame components, the support frame can be quickly and easily adjusted to a number of lengths and widths. Thus, the support frame is size-adjustable to fit most conventional wheelchair frames and to accommodate wheelchair patients of various sizes. As the physical needs of the wheelchair user change, the device can be size-adjusted to accommodate those needs. The T-shaped frame components may include spring biased detent mechanisms for preventing the frame components from being inadvertently unnested during adjustment of the support frame.

The size-adjustable load supporting device includes a load supporting panel which is removably fastened to the support frame. The load supporting panel serves two primary functions. First, when fastened to the support frame, the panel secures the four T-shaped components at a desired spaced apart distance from one another to thereby define a length and depth of the support frame. Second, the panel serves to support the weight of the wheelchair patient.

Preferably, the load supporting panel is removably fastened to the size-adjustable support frame with a suitable hook and loop fastener, such as VELCRO®. The "loop" part of the hook and loop fastener covers substantially the entire bottom surface of the panel. The "hook" part of the hook and loop fastener covers at least a portion of the size-adjustable support frame. Preferably, at least a portion of each frame component with be covered on a top surface with the "hook" part of the fastener. Thus, when fastened to the support frame, the panel secures the positions of the frame components relative to one another to thereby define a rigid wheelchair support having a desired length and width.

The size-adjustable load supporting device of the present invention can be used to replace the conventionally used "sling" type wheelchair seat by mounting the system substantially horizontally between the spaced apart rails of a conventional wheelchair frame. Alternatively, the same device can be mounted substantially vertically on a conventional wheelchair frame so that the load supporting panel is used as a back rest for the wheelchair user.

The size-adjustable load supporting device includes four substantially J-shaped mounting brackets for mounting the device to a conventional wheelchair frame, one of the J-shaped brackets being connected to each of the T-shaped frame components. The hook portion of the "J" is adapted for engaging the spaced apart rails of a conventional wheelchair so that the load supporting panel of the device is suspended between the spaced apart rails.

Preferably, each J-shaped mounting bracket includes a plurality of laterally extending slots through which bolts, or other mechanical fasteners, slidably and rotatably connect the bracket to the extended segments of the support frame. Each bracket is therefore slidably and rotatably adjustable relative to the support frame. In an alternative embodiment, each bracket includes a longitudinally extending slot through which a bolt, or other mechanical fastener, slidably connects the bracket to the support frame.

Each of the J-shaped brackets is independently adjustable, slidably and rotatably, to thereby allow the device to be mounted to a conventional wheelchair frame at a variety of angles to achieve various therapeutically significant functions. For example, when the device is used as a seat base, the mounting brackets can be adjusted to provide a forward or rearward tilt to the seat base, or to create a tilt to one side or the other.

Front and rear locking clips are used to prevent the J-shaped mounting brackets from sliding along the rails of the wheelchair frame. Front locking clips are attached to the rails to prevent the front mounting brackets from sliding forwardly and prevent the device from moving out of position. Rear locking clips are attached to the rails behind the rear mounting brackets to prevent them from sliding rearwardly. The rear locking clips each include a tongue which is placed over the top of the hook portion of the rear mounting brackets to prevent the hook portion of the rear mounting brackets from inadvertently disengaging the rails.

While the principal advantages and features of the present invention have been described above, a more complete and thorough understanding and appreciation for the invention may be attained by referring to the drawings and description of the preferred embodiment which follow.

DETAILED DESCRIPTION OF THE PREFERRED EMBODIMENT

Figure 1:
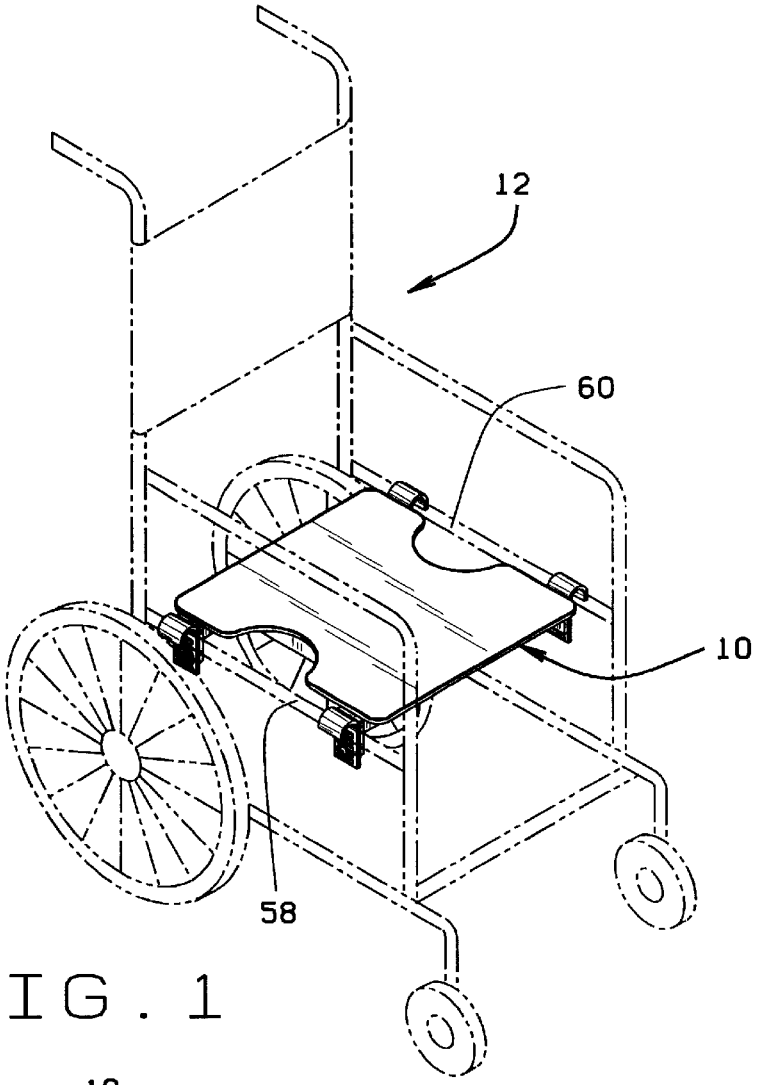
FIG. 1 is an isometric view of the size-adjustable load supporting device of the present invention being used as a seat base mounted to a conventional wheel chair frame (shown in phantom).
Figure 3:
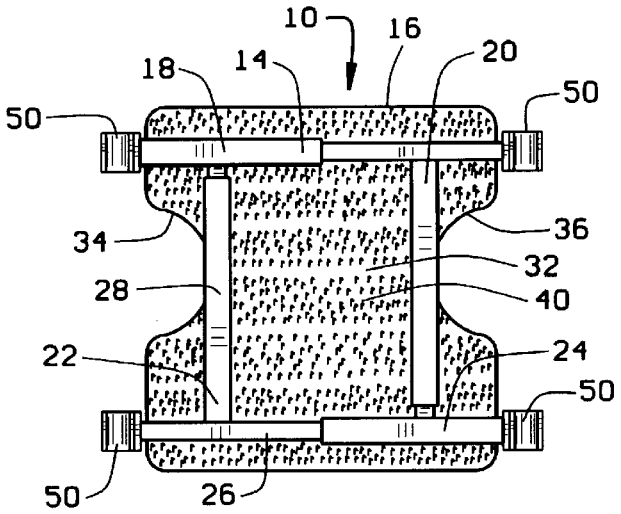
FIG. 3 is a bottom view of the size-adjustable load supporting device.
Figure 4:
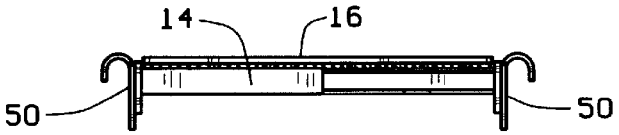
FIG. 4 is a front elevational view of the size-adjustable load supporting device.
Figure 5:
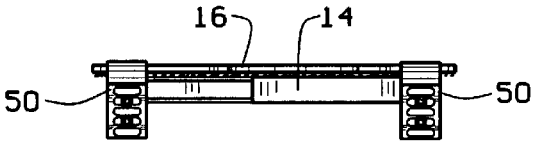
FIG. 5 is a side elevational view of the size-adjustable load supporting device.

The size-adjustable load supporting device of the present invention may be used with a conventional wheelchair frame. The device is shown generally as 10 in FIG. 1 in the environment of a conventional wheelchair, which is depicted in phantom as 12. As shown in FIG. 1, the device 10 is preferably used as a seat base in place of a conventional soft "sling" type wheelchair seat. As best shown in FIGS. 3–5, the size-adjustable load supporting device 10 is generally comprised of a size-adjustable support frame 14 and a load supporting panel 16 removably fastened to the support frame 14.

In the preferred embodiment of the present invention, the support frame 14 has a generally square configuration which, as shown in FIGS. 3, 6, 7 and 8, is defined by four substantially T-shaped frame components 18, 20, 22, 24 which are mounted together. The T-shaped frame components 18, 20, 22, 24 are preferably constructed from extruded aluminum tubing having a square cross section, but could be constructed from other materials which would function equivalently. The T-shaped frame components 18, 20, 22, 24 are dimensioned to slidably nest with one another at a range of spaced apart distances.

Figure 6:
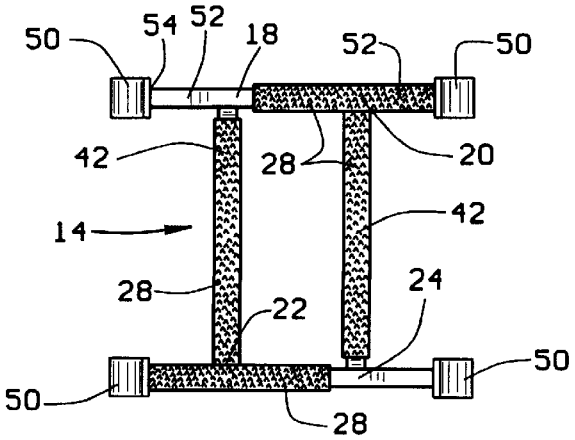
FIG. 6 is a top view of a variant embodiment of the device, shown with the load supporting panel removed and with the support frame components fully nested with one another.
Figure 7:
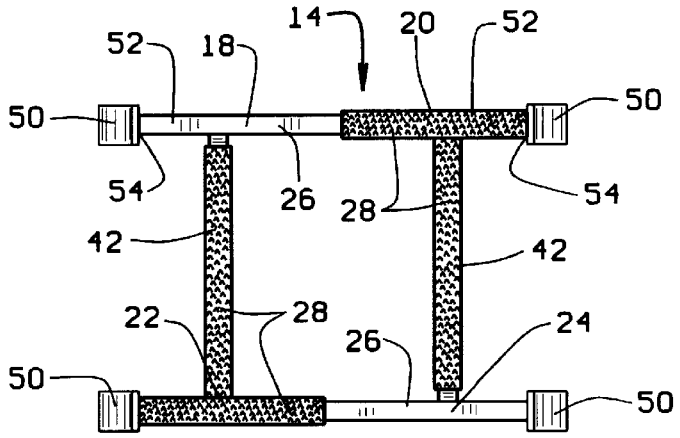
FIG. 7 is a top view of the device of FIG. 6, shown with the load supporting panel removed and with the amount of nesting in some of the support frame components adjusted to widen the support frame.
Figure 8:
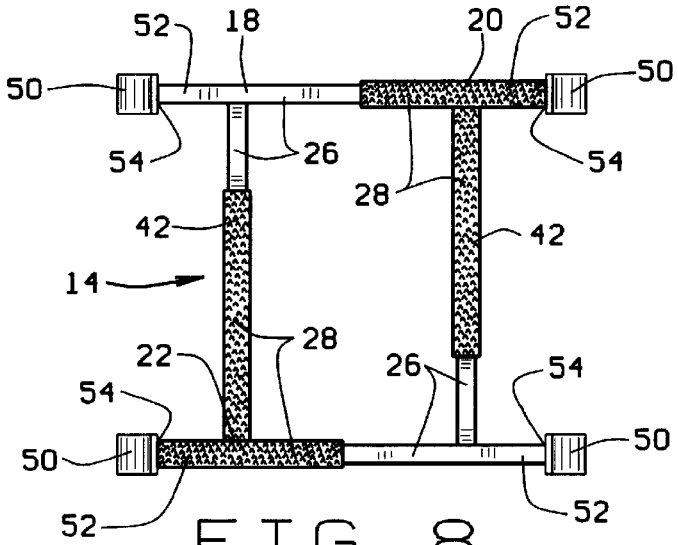
FIG. 8 is a top view of the device of FIG. 6, shown with the load supporting panel removed and with the amount of nesting in the support frame components adjusted to lengthen and widen the support frame.

Each T-shaped frame component is defined by two legs 26 or 28 which intersect to form a "T". As shown in FIGS. 6–8, some of the legs 26 are penetrating legs and other legs 28 are receiving legs. The penetrating legs 26 have a first cross-sectional dimension and the receiving legs 28 have a second cross-sectional dimension larger than the first cross-sectional dimension. Thus, the receiving legs 28 are configured for telescoping reception of the penetrating legs 26.

In FIGS. 6, 7 and 8, the support frame 14 is shown to include two T-shaped frame components 18, 22 comprised solely of receiving legs 28 and two T-shaped frame components 20, 24 comprised solely of penetrating legs 26. It is to be understood, however, that other configurations could be used without departing from the scope of this invention. For example, as shown in FIGS. 3–5, each T-shaped frame component could consist of one penetrating leg 26 and one receiving leg 28.

The spaced apart distances of the T-shaped frame components 18, 20, 22, 24 relative to one another depends upon the degree of nesting or telescoping of the components. By varying the amount of nesting or telescoping of the components 18, 20, 22, 24 the support frame 14 can be quickly and easily adjusted to a number of lengths and widths. Thus, the support frame 14 is size-adjustable to fit most conventional wheelchair frames and to accommodate wheelchair patients of various sizes.

In FIG. 6, the support frame 14 is shown with the T-shaped frame components 18, 20, 22, 24 fully nested with one another. FIG. 7 shows the support frame 14 with the amount of nesting adjusted laterally to widen the frame. FIG. 8 shows the support frame 14 with the amount of nesting adjusted both laterally and longitudinally to thereby lengthen and widen the frame.

The T-shaped frame components 18, 20, 22, 24 may employ spring biased detent mechanisms for preventing the frame components from being inadvertently unnested during adjustment of the support frame 14. Such detent mechanisms are well known in the art. Preferably, each receiving leg 28 includes a detent hole (not shown) located near its distal end, and each penetrating leg 26 includes a spring biased detent pin (not shown) near its distal end. The detent hole is configured to receive the detent pin when the detent pin and detent hole are aligned with one another. When the penetrating leg 26 and receiving leg 28 are adjusted relative to one another so that the detent pin is aligned with the detent hole, the detent pin springs into a locked position. The detent pin can be moved back to the unlocked position by manually depressing the pin against the spring bias. In the unlocked position, the detent pin is free to slide along an interior surface of the receiving leg 28. It is to be understood that locking means other than the spring bias detent mechanism described above may be employed to preventing inadvertent unnesting of the frame components.

Figure 2:
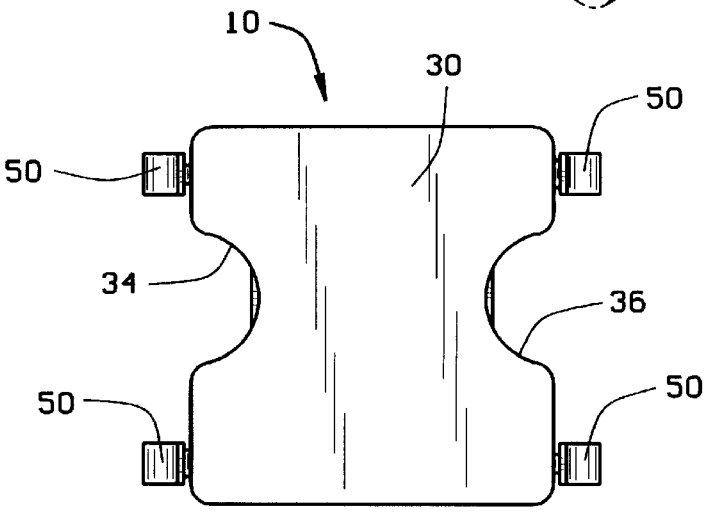
FIG. 2 is a top view of the size-adjustable load supporting device.

As best shown in FIGS. 2 and 3, the device 10 includes a load supporting panel 16 having a generally square shape. The panel 16 has a top surface 30 and a bottom surface 32 and includes two laterally opposite cut-outs 34, 36 which allow for various configurations of wheelchair cross bars.

The load supporting panel 16 is removably fastened to the support frame 14. When fastened to the support frame 14, the panel 16 fixes the four T-shaped components 18, 20, 22, 24 at a desired spaced apart distance from one another to thereby define a fixed length and depth of the support frame 14. The panel 16 also serves as a durable, lightweight seat capable of accommodating the weight of the majority of wheelchair patients. Preferably, the panel 16 is made of acrylonitrile butadiene styrene resin (commonly referred to as ABS) or a composite equivalent, but could be constructed from any durable, lightweight material which resists bowing and rotting.

In the preferred embodiment, the load supporting panel 16 is removably fastened to the size-adjustable support frame 14 with a suitable hook and loop fastener, such as VELCRO®. The "loop" part 40 of the hook and loop fastener covers substantially the entire bottom surface 32 of the panel 16. The "hook" part 42 of the hook and loop fastener covers portions of the size-adjustable support frame 14. It is to be understood that the roles of the "hook" and "loop" parts could be reversed without departing from the scope of this invention. It is also to be understood that means other than a hook and loop fastener could be used for removably fastening the panel 16 to the support frame 14. However, a hook and loop fastener is preferred because, among other things, it is relatively inexpensive and requires no tools of any kind.

To ensure that each frame component 18, 20, 22, 24 is properly secured with respect to the others, at least a portion of each receiving leg 28 should be covered with the "hook" part 42 of the fastener. Thus, when fastened to the support frame 14, the panel 16 secures the positions of the frame components 18, 20, 22, 24 relative to one another to thereby define a rigid wheelchair seat having a desired length and width which is fixed.

Figure 9:
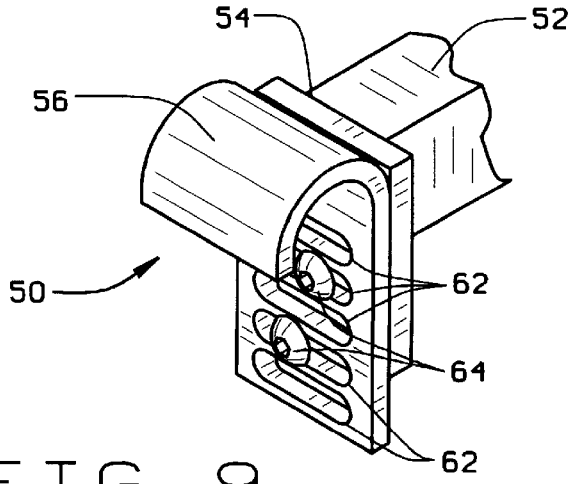
FIG. 9 is an isometric detail view of one of the J-shaped mounting brackets of the device.
Figure 10:
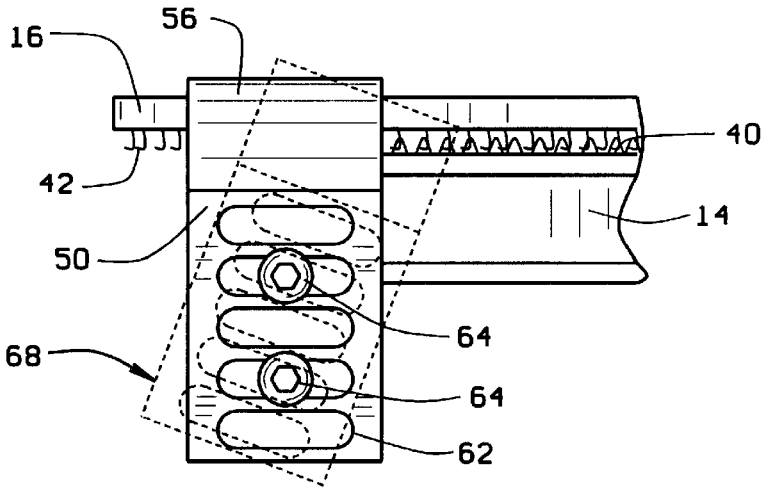
FIG. 10 is a side detail view of one of the J-shaped mounting brackets of the device, with an alternate rotated position of the bracket shown in phantom.

The size-adjustable load supporting device 10 includes four substantially J-shaped mounting brackets 50 for mounting the device 10 to a conventional wheelchair frame 12. FIGS. 9 and 10 show detailed views of the J-shaped mounting brackets 50. One of the brackets 50 is connected to each of the T-shaped frame components 18, 20, 22, 24.

As described above, each of the T-shaped frame components 18, 20, 22, 24 is defined by two intersecting legs which define the "T". As shown in FIGS. 3, 6, 7 and 8, one leg of each "T" includes an extended segment 52 which extends out laterally beyond the intersection of the two legs. One J-shaped bracket 50 is connected to the distal end 54 of each extended segment 52.

The hook portion of the "J" 56 is adapted for engaging the spaced apart rails 58, 60 of a conventional wheelchair 12 so that the load supporting panel 16 of the device 10 is suspended between the spaced apart rails 58, 60. The hook portions 56 of the J-shaped brackets 50 are dimensioned to snap freely on to most standard rails 58, 60 and can be easily removed from the rails.

As best shown in FIGS. 9 and 10, each J-shaped mounting bracket 50 includes a plurality of laterally extending slots 62 through which bolts 64, or other mechanical fasteners, connect the bracket 50 to the extended segments 52 of the support frame 14. In the preferred embodiment, each bracket 50 includes five laterally extending slots 62 arranged in a vertical series to permit vertical adjustment of the device 10 relative to the wheelchair frame 12.

Each bracket 50 is laterally slidable relative to the support frame 14. Each bracket 50 is also rotatable relative to the support frame 14. FIG. 10 illustrates a rotated position 68 of the J-shaped bracket 50.

Figure 11:
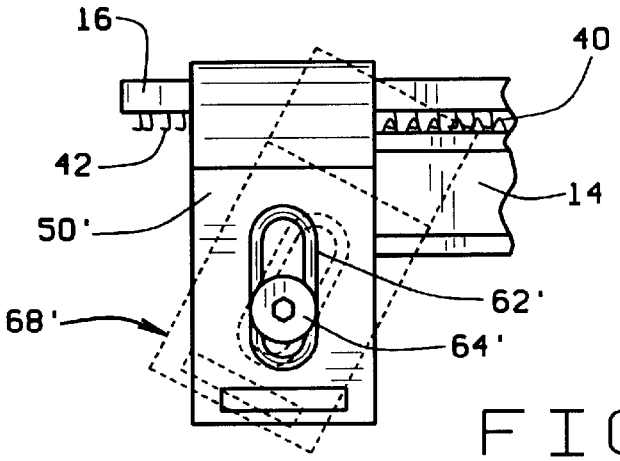
FIG. 11 is a side detail view of an alternate embodiment of the J-shaped mounting brackets of the device, with a rotated position of the bracket shown in phantom.

FIG. 11 illustrates an alternative embodiment of the J-shaped mounting bracket 50' including a longitudinally extending slot 62' through which bolt 64', or an equivalent mechanical fastener, slidably and rotatably connects the bracket 50' to the extended segments 52 of the support frame 14. FIG. 11 also shows a rotated position 68' of bracket 50'.

Each of the J-shaped brackets 50 and 50'is independently adjustable, slidably and rotatably, to thereby allow the device 10 to be mounted to a conventional wheelchair frame 12 at a variety of angles to achieve various therapeutically significant functions. For example, the mounting brackets 50 and 50' can be adjusted to tilt the user back in the chair to improve stability. As another example, the mounting brackets 50 and 50' on only one side of the device 10 could be raised to create a tilt to one side or the other.

As described above, the size-adjustable load supporting device of the present invention can be used to replace the conventionally used "sling" type wheelchair seat by mounting the device 10 substantially horizontally between the spaced apart rails 58, 60 of a conventional wheelchair frame 12. Also, if an inflatable wheelchair cushion (such as the one disclosed in co-assigned U.S. Pat. No. 5,561,875) is being used, the device 10 can be suspended low enough between the spaced apart rails of the wheelchair frame to accommodate for the thickness of the cushion.

Figure 12:
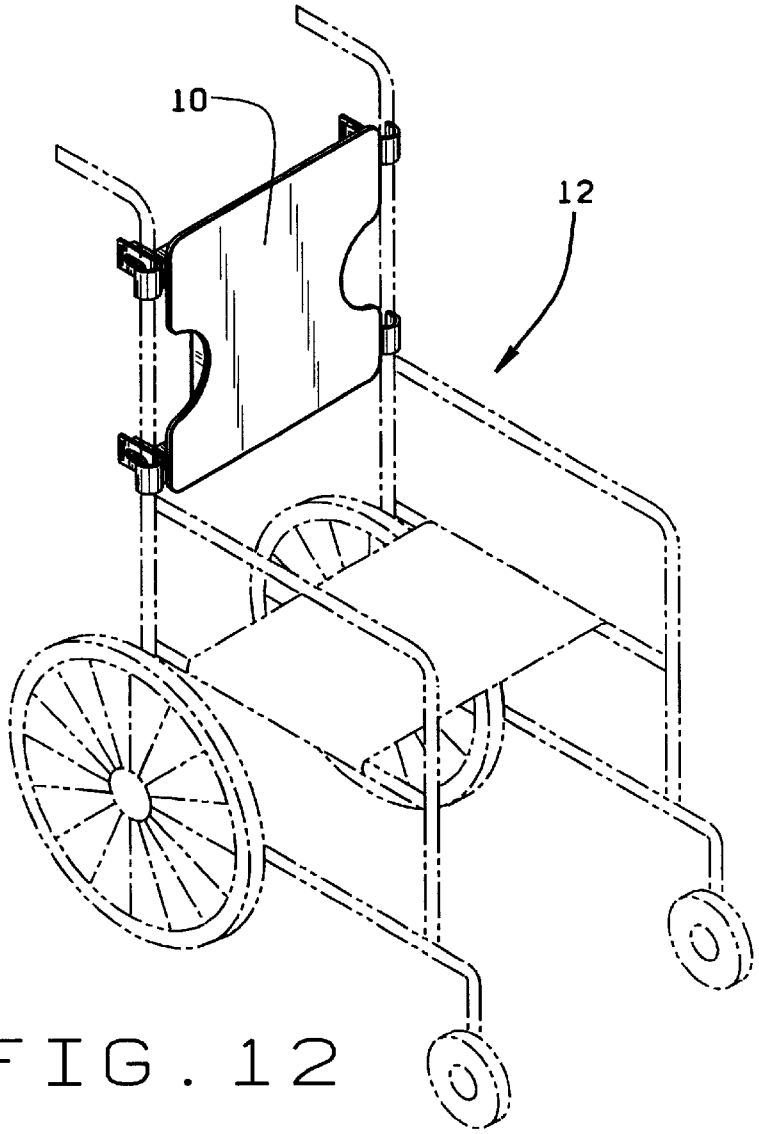
FIG. 12 is an isometric view of the size-adjustable load supporting device of the present invention being used as a back rest mounted to a conventional wheelchair frame (shown in phantom).

In the alternative use shown in FIG. 12, the same device 10 can be mounted substantially vertically on a conventional wheelchair frame 12 with the load supporting panel 16 being used as a back rest for the wheelchair user. When used as a back rest, the device may require mounting brackets other than the J-shaped mounting brackets 50 described above in order to keep from falling off of the back of the wheelchair frame 12. Selection of appropriate mounting brackets suitable for this alternative use of the device 10 would clearly be within the knowledge of one skilled in the art.

Figure 13:
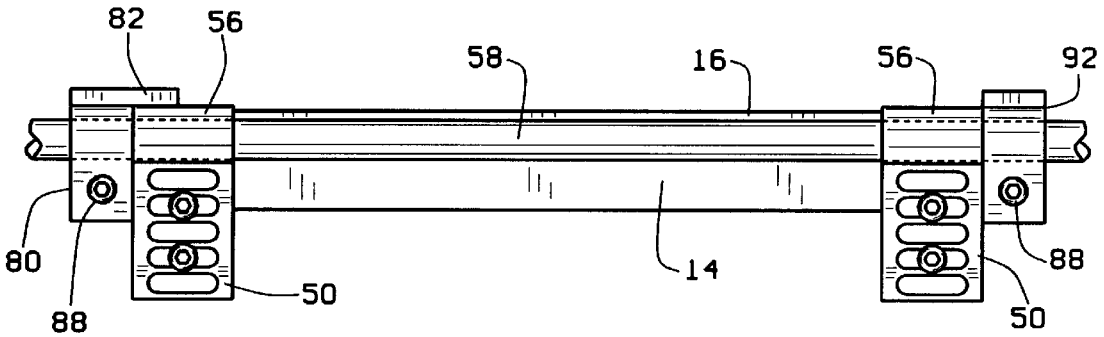
FIG. 13 is a side elevational view of the size-adjustable load supporting device mounted to the cross brace of a conventional wheelchair frame.

In the preferred embodiment of the present invention, front locking clips 92 and rear locking clips 92 are used to prevent the J-shaped mounting brackets 50 from sliding along rails 58 and 60 of the wheelchair frame 12. As shown in FIG. 13, a front locking clip 92 is attached to the rail 58 in front of the J-shaped mounting bracket 50. The front locking clip 92 prevents the mounting bracket 50 from sliding forwardly and prevents the device 10 from moving out of position. The front locking clip 92, however, does not prevent the mounting bracket 50 from being vertically disengaged from the rail 58. Therefore the device 10 may be snapped out so that the wheelchair may be collapsed for transportation and storage.

Figure 14:
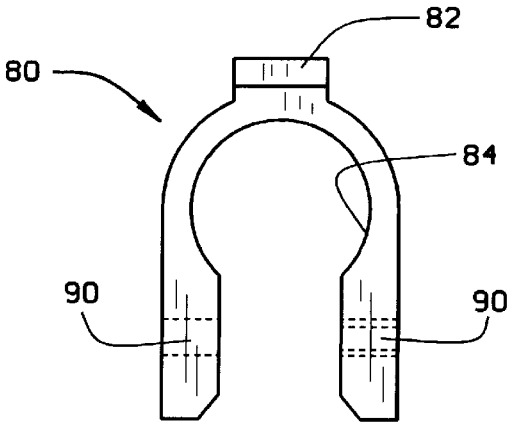
FIG. 14 is an end detail view of one of the horseshoe locking clips used in the present invention.

As shown in FIG. 13, the rear locking clip 80 may be attached to the back of the rail 58 behind the rear mounting bracket 50. The rear locking clip 80 includes a tongue 82 which may be placed over the top of the hook portion 56 of the mounting bracket 50. FIG. 14 shows an end detail view of the locking clip. The rear locking clip 80 prevents the mounting bracket 50 from sliding rearwardly, and the tongue 82 prevents the hook portion 56 of the mounting bracket 50 from inadvertently disengaging the rail 58.

Both locking clips 80 and 92 are mounted on rails 58 and 60 with bolts 88, or other equivalent mechanical fasteners. To mount the device 10 on the wheelchair frame 12, the hook portion 56 of the rear mounting brackets 50 are snapped onto the rails 58 and 60 and then slid back under the tongues 82 of the rear locking clips 80. The front mounting brackets 50 are then snapped onto the rails 58 and 60 immediately behind the front locking clips 92.

While the present invention has been described by reference to a specific embodiment and a particular use, it should be understood that other configurations could be constructed, and different uses could be made, without departing from the scope of the invention as set forth in the following claims.

What is claimed is:

1. A seat device with a size-adjustable support frame and a load supporting panel, said seat device comprising:

said size-adjustable support frame including a plurality of penetrating frame elements and a plurality of receiving frame elements, an end of each penetrating frame element being telescoped within an end of one of the receiving frame elements, the plurality of penetrating frame elements and the plurality of receiving frame elements being telescoped together to define said size adjustable frame as a generally square width and death size-adjustable support frame, the receiving frame elements and the penetrating frame elements being adapted for telescoping movement relative to one another to adjust the size of the support frame by selectively varying the amount of telescoping; and said load supporting panel removably fastened to said support frame, said panel being adapted for securing the penetrating frame elements and the receiving frame elements at telescoping positions relative to one another when said panel is fastened to said support frame to thereby define a width and a depth of the support frame.

2. The seat device of claim 1 wherein at least some of the penetrating frame elements and receiving frame elements are telescoped together in a lateral direction for adjusting the width of said support frame, and wherein at least some of the penetrating frame elements and receiving frame elements are telescoped together in a longitudinal direction for adjusting the depth of said support frame.

3. The seat device of claim 1 wherein said panel is removably fastened to said support frame with a hook and loop fastener.

4. A seat device with a size-adjustable support frame and a load supporting panel, said seat device comprising:

said size-adjustable support frame having a generally square configuration defined by a plurality of penetrating frame elements and a plurality of receiving frame elements, the receiving frame elements being telescoped together with the penetrating frame elements in width and depth dimensions, an end of each penetrating frame element being telescoped within an end of one of the receiving frame elements, the receiving frame elements and the penetrating frame elements being adapted for telescoping movement relative to one another to adjust the size of the support frame by selectively varying the amount of telescoping; and said load supporting panel removably fastened to said support frame, said load supporting panel being adapted to secure the receiving frame elements and the penetrating frame elements at desired telescoping positions relative to one another when said load supporting panel is fastened to said support frame to thereby define a width and a depth of the support frame.

5. The seat device of claim 4 wherein the plurality of penetrating frame elements and the plurality of receiving frame elements are telescoped to one another to define a generally square configuration of the size-adjustable support frame, at least some of the penetrating frame elements and receiving frame elements being slidable relative to one another in a lateral direction for adjusting the width of said support frame, and wherein at least some of the penetrating frame elements and receiving frame elements are slidable relative to one another in a longitudinal direction for adjusting the depth of said support frame.

6. The seat device of claim 5 wherein said load supporting panel is removably fastened to said support frame with a hook and loop fastener.

7. The seat device of claim 6 wherein said load supporting panel has a load supporting top surface and a bottom surface opposite the load supporting top surface, and wherein the hook and loop fastener is comprised of a hook component and a loop component which is complementary to the hook component, one of the hook and loop components covering substantially the entire bottom surface of the panel, and the other of the hook and loop components covering at least a portion of the size-adjustable support frame.

8. The seat device of claim 6 wherein said load supporting panel is a seat panel removably fastened to a top side of said size-adjustable support frame for use as a seat base in a conventional wheelchair frame.

9. The seat device of claim 8 including a plurality of substantially J-shaped mounting brackets connected to said support frame, the mounting brackets being adapted for engaging spaced apart rails of a conventional wheelchair so that the seat panel is suspended between the spaced apart rails.

10. The seat device of claim 6 wherein said load supporting panel is a back support panel removably fastened to one side of said size-adjustable support frame for use as a back rest in a conventional wheelchair frame.

11. A seat device with a size-adjustable support frame and a load supporting panel, said seat device comprising:

said support frame having a generally square configuration defined by four substantially T-shaped frame components mounted together at desired relative positions, the T-shaped frame components being dimensioned to slidably nest with one another at a range of said positions along said components whereby said support frame is capable of a variety of widths and depths depending upon the amount of nesting; and said load supporting panel removably fastened to said support frame, said panel being adapted to secure the four T-shaped components at said desired relative positions to thereby define a width and depth of the support frame.

12. The seat device of claim 11 wherein said load supporting panel is removably fastened to said support frame with a hook and loop fastener.

13. The seat device of claim 11 further comprising means for mounting the device on spaced apart rails of a conventional wheelchair frame.

14. The seat device of claim 13 wherein said load supporting panel is a seat panel removably fastened to a top side of said size-adjustable support frame for use as a seat base in a conventional wheelchair.

15. The seat device of claim 14 wherein said means for mounting the device includes a plurality of substantially J-shaped mounting brackets connected to said support frame, the mounting brackets being adapted for engaging the spaced apart rails of a conventional wheelchair so that the seat panel is suspended between the spaced apart rails.

16. The seat device of claim 15 wherein the J-shaped mounting brackets are vertically adjustable relative to the support frame to allow the seat panel to be suspended between the spaced apart rails at a range of heights.

17. The seat device of claim 15 wherein the J-shaped mounting brackets are rotatably connected to said support frame to allow the seat panel to be suspended between the spaced apart rails at a range of angles.

18. The seat device of claim 13 wherein said load supporting panel is a back support panel removably fastened to one side of said size-adjustable support frame for use as a back rest in a conventional wheelchair.

* * * * *